US012799620B2

(12) United States Patent
Pan et al.

(10) Patent No.: US 12,799,620 B2
(45) Date of Patent: Nov. 17, 2026

(54) METHODS FOR ADJUSTING SURFACE COLOR AND PROPERTIES OF TANTALUM LAYERS

(71) Applicant: ZHEJIANG UNIVERSITY OF SCIENCE & TECHNOLOGY, Hangzhou (CN)

(72) Inventors: Taijun Pan, Hangzhou (CN); Bingren Meng, Hangzhou (CN); Yanjie Ren, Hangzhou (CN); Xiaoxiao Li, Hangzhou (CN)

(73) Assignee: ZHEJIANG UNIVERSITY OF SCIENCE & TECHNOLOGY, Hangzhou (CN)

( * ) Notice: Subject to any disclaimer, the term of this patent is extended or adjusted under 35 U.S.C. 154(b) by 20 days.

(21) Appl. No.: 19/093,327

(22) Filed: Mar. 28, 2025

(65) Prior Publication Data

US 2025/0361643 A1 Nov. 27, 2025

(30) Foreign Application Priority Data

May 22, 2024 (CN) ..... 202410636472.X

(51) Int. Cl.

| | |
|---|---|
| ***C25D 11/26*** | (2006.01) |
| ***C23C 4/08*** | (2016.01) |
| ***C23C 4/137*** | (2016.01) |
| ***C23C 4/18*** | (2006.01) |

(52) U.S. Cl.

CPC ..... *C25D 11/26* (2013.01); *C23C 4/08* (2013.01); *C23C 4/137* (2016.01); *C23C 4/18* (2013.01)

(58) Field of Classification Search

CPC ..... C25D 11/02–246

See application file for complete search history.

(56) References Cited

U.S. PATENT DOCUMENTS

2024/0245507 A1 7/2024 Bauman et al.

FOREIGN PATENT DOCUMENTS

| | | | | |
|---|---|---|---|---|
| CN | 103526262 A | | 1/2014 | |
| CN | 115487353 A | | 12/2022 | |
| GB | 2063920 A | * | 6/1981 | ..... C25D 11/14 |

* cited by examiner

*Primary Examiner* — Hosung Chung

(74) *Attorney, Agent, or Firm* — PORUS IP LLC

(57) ABSTRACT

Method for adjusting surface color and properties of a tantalum layer, including: forming the tantalum layer with a thickness of 40-70 μm on a surface of a stainless steel substrate; grinding the tantalum layer, and polishing to planarize the tantalum layer to achieve a lustrous metallic finish, and controlling the thickness of the tantalum layer within a range of 40-50 μm; and using the tantalum layer as a working anode and a stainless steel as an auxiliary cathode, fixing both the tantalum layer and the stainless steel in an electrolysis tank and immersing both in a 5-10% dilute sulfuric acid solution doped with NaCl, energizing a pulsed power supply, and obtaining samples of different thicknesses of tantalum oxide layers by adjusting at least one of an oxidation time, a current, a voltage, and a frequency of a power supply.

10 Claims, 1 Drawing Sheet

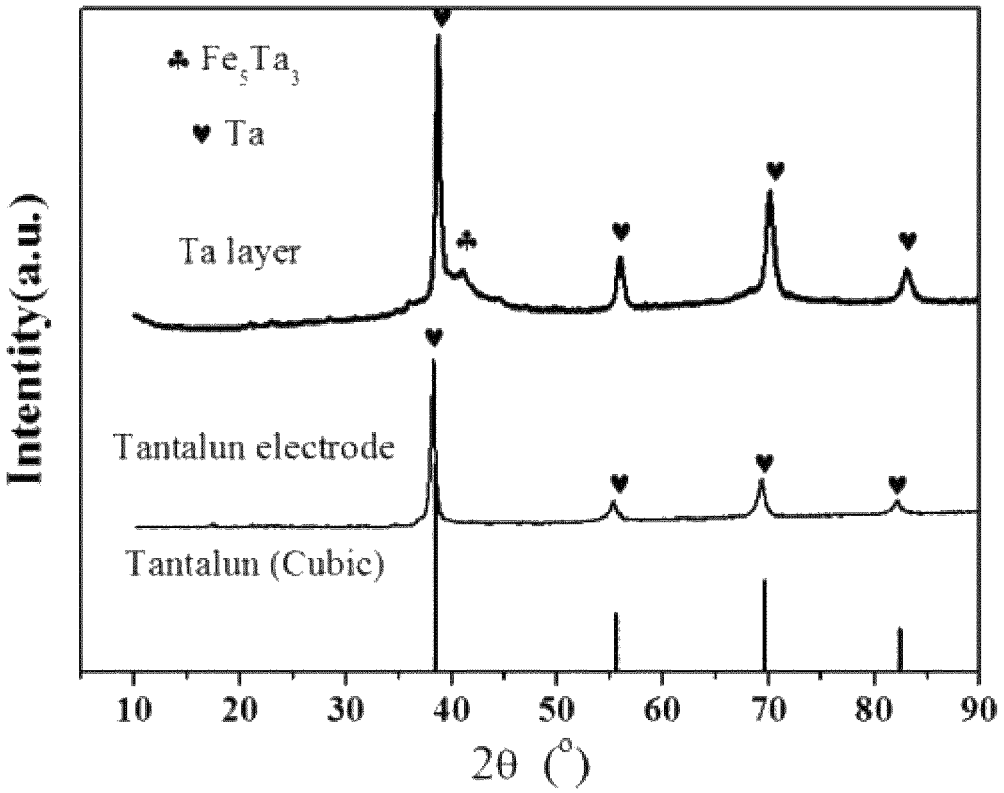
♣ $Fe_5Ta_3$
♥ Ta
Ta layer
Tantalun electrode
Tantalun (Cubic)
Intentity(a.u.)
10
20
30
40
50
60
70
80
90
2θ (°)

METHODS FOR ADJUSTING SURFACE COLOR AND PROPERTIES OF TANTALUM LAYERS

CROSS-REFERENCE TO RELATED APPLICATIONS

This application claims priority of Chinese Patent Application No. 202410636472.X, filed on May 22, 2024, the entire contents of which are incorporated herein by reference.

TECHNICAL FIELD

The present disclosure generally relates to a method for regulating the surface color and properties of a tantalum layer.

BACKGROUND

Tantalum, characterized by a high melting point of 2996 °C, a shiny appearance, and a hard texture, exhibits excellent electrical conductivity and remarkable ductility, along with exceptional chemical stability, remaining unreactive with any acid or alkali solutions at room temperature. Due to numerous advantages, there is a growing interest in tantalum within various sectors, including aerospace, biomedical, weapons industry, chemical industry, semiconductors, and electronics.

Additionally, utilizing the excellent biocompatibility and corrosion resistance of tantalum, many researchers and engineers have employed various surface technologies to prepare tantalum coatings on the surface of metallic or non-metallic materials. The approach combines the inherent properties of tantalum with those of the substrate materials, thus improving the corrosion resistance of the substrate products to further broaden their application scope. For example, tantalum has attracted the attention of researchers in orthopedics, dentistry, and materials science due to the excellent corrosion resistance resulted from spontaneous formation of an extremely stable oxide ($Ta_2O_5$) on its surface, the excellent biocompatibility, and antimicrobial properties.

Currently, many researchers have developed a variety of surface technologies to prepare tantalum coatings, with the goal of reducing the preparation cost for broader application. The primary techniques include physical vapor deposition (CVD) and chemical vapor deposition (PVD). For example, magnetron sputtering in CVD is a commonly used method to prepare tantalum coatings, which has the advantages of good surface quality, low deposition temperature, and the substrate not easy to deform. However, its preparation efficiency is relatively low, and the prepared tantalum coating is brittle and easy to crack and spall. In addition, due to the constraints of thickness limitation of the prepared coating, the density of the coating is insufficient, which cannot effectively block the erosion of corrosive media. Further, the CVD process involves heating a tantalum halide and introducing hydrogen at a certain temperature for reduction to form a tantalum coating. The substrate metal deforms due to high temperature, which affects the quality of the coating, such as producing cracks on the surface caused by large residual thermal stress. Moreover, the formation rate and thickness of the coating cannot be stably controlled, the production process is also prone to produce hydrogen halide and other byproducts, causing pollution to the environment. Additionally, the CVD deposition equipment is very expensive. It can be found that the PVD and CVD techniques require expensive equipment and specific places, etc. in the preparation of tantalum coatings, which also further increase the manufacturing cost.

Therefore, it is indicated that the significant disparity in physical properties between the refractory tantalum and substrate materials such as the stainless steel substrate and titanium metal leads to several drawbacks in the resulting tantalum coatings. These drawbacks include high internal stress, increased brittleness, and poor adhesion strength between the coating and the stainless steel substrate, thereby affecting the promotion of these technologies and limiting the application of tantalum under certain harsh conditions.

SUMMARY

One or more embodiments of the present disclosure provide a method for adjusting surface color and properties of a tantalum layer, comprising:

step (a) forming the tantalum layer with a thickness of 40-70 μm on a surface of a stainless steel substrate;

step (b) grinding the tantalum layer, followed by polishing to planarize the tantalum layer to achieve a lustrous metallic finish, and controlling the thickness of the tantalum layer within a range of 40-50 μm; and step (c) using the tantalum layer as a working anode and a stainless steel as an auxiliary cathode, fixing both the tantalum layer and the stainless steel in an electrolysis tank and immersing both the tantalum layer and the stainless steel in a 5-10% dilute sulfuric acid solution doped with NaCl, energizing a pulsed power supply, and obtaining samples of different thicknesses of tantalum oxide layers by adjusting at least one of an oxidation time, a current, a voltage, and a frequency of a power supply; wherein a change in surface thickness of the tantalum layer is capable of resulting in corresponding changes in the surface color and properties of the tantalum layer.

In some embodiments, step (a) comprises:

step (i) pre-treating the stainless steel substrate and pre-treating a tantalum rod formed by machining tantalum; and step (ii) connecting the pre-treated stainless steel substrate with a negative pole of a high-frequency pulsed power supply, inserting the pre-treated tantalum rod into a rotatable electrode gun, causing the pre-treated tantalum rod connecting with a positive pole of the high-frequency pulsed power supply, fixing the pre-treated tantalum rod and adjusting a rotational speed of the pre-treated tantalum rod, while turning on a protective gas to protect the pre-treated tantalum rod from oxidization and adjusting the rotational speed and parallel movement of the pre-treated tantalum rod, the pre-treated tantalum rod as a working electrode forming the tantalum layer on the surface of the stainless steel substrate.

In some embodiments, in the step (i), the pre-treating the stainless steel substrate comprises: grinding the stainless steel substrate sequentially on a pre-grinder using a sandpaper, and carrying out a sandblasting treatment to remove residual stresses on the surface and maintaining a certain degree of surface roughness for enhancing bonding between the tantalum layer and the stainless steel substrate, and then placing the stainless steel substrate in acetone for ultrasonically cleaning to remove impurities from the surface, and air-drying.

In some embodiments, in the step (i), the pre-treating tantalum rod formed by machining tantalum comprises: processing tantalum with a purity of 99.9% or more into a round rod, a head of the round rod being processed into a conical shape, removing surface oxide scale by grinding with a sandpaper, and then removing surface stains of the tantalum rod by ultrasonically cleaning with acetone.

In some embodiments, when a flow rate of the protective gas is adjusted to cause that a brilliant blue-white glow is released between the tantalum rod and the stainless steel substrate, the flow rate of the protective gas is capable of ensuring that the tantalum rod does not oxidize under the protective gas.

In some embodiments, in the step (ii), during the process of forming the tantalum layer on the surface of the stainless steel substrate, a cumulative single spot deposition time does not exceed 80 s.

In some embodiments, in the step (ii), a rotational speed of the tantalum rod is within a range of 200 r/min-500 r/min; a flow rate of the protective gas is within a range of 8-20 L/min; an output power of the power supply is within a range of 400-1000 W; an output voltage of the power supply is within a range of 20-50 V; a frequency of the power supply is within a range of 400-2000 Hz; a discharge pulse width is within a range of 40-90 μs; and a specific deposition time is within a range of 0.4-0.9 min/cm$^2$.

In some embodiments, wherein in the step (b), a gloss Ra of the tantalum layer is within a range of 0.1-0.2 μm.

In some embodiments, in the step (c), parameters of the pulsed power supply include an output voltage of 10-20 V, a current density of 30-50 mA/cm$^2$, a single-phase pulse width of 100-200 μs, and a pulse step frequency of 50-200 Hz.

In some embodiments, in the step (c), a working distance between the working anode and the auxiliary cathode is within a range of 4-6 cm.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, wherein:

FIG. 1 is an X-ray diffraction (XRD) pattern of a tantalum layer according to some embodiments of the present disclosure.

DETAILED DESCRIPTION

As shown in this disclosure and the claims, unless the context clearly suggests an exception, the words "a", "an", and/or "the" do not refer specifically to the singular, but also include the plural. Generally, the terms "including" and "comprising" suggest only the inclusion of clearly identified steps and elements. In general, the terms "including" and "comprising" only suggest the inclusion of explicitly identified steps and elements that do not constitute an exclusive list, and the method or apparatus also include other steps or elements.

To overcome the defects of the prior art, the present disclosure provides a method for regulating the surface color and properties of the tantalum layer, which is not only capable of forming the tantalum layer on the stainless steel substrate well, but also obtaining the tantalum oxide layers of different colors and different surface properties. The obtained tantalum layer can effectively hinder the outward exudation of nickel ions from the stainless steel substrate. In addition, the obtained tantalum layer has high hardness, excellent wear resistance, and good biocompatibility.

Embodiments of the present disclosure provide a method for regulating surface color and properties of a tantalum layer. The person skilled in the art can achieve the technical scheme by regulating the process parameters appropriately based on the contents of the present disclosure. In particular, it should be noted that all similar substitutions and alterations are obvious to those skilled in the art, and they fall within the protection scope of this disclosure. The methods and use of the present disclosure have been described by way of preferred embodiments, and it is obvious that the relevant person can make modifications or appropriate changes and combinations to the methods and use of the present disclosure without departing from the content, spirit, and scope of the present disclosure, to realize and apply the techniques of the present disclosure.

Embodiments of the present disclosure provide a method for regulating surface color and properties of a tantalum layer, comprising:

step (a): forming the tantalum layer with a thickness of 40-70 μm on a surface of a stainless steel substrate;

step (b): grinding the tantalum layer, followed by polishing to planarize the tantalum layer to achieve a lustrous metallic finish, and controlling the thickness of the tantalum layer within a range of 40-50 μm. Specifically, the thickness of the tantalum layer may be 40 μm. The surface of the tantalum layer may be cleaned with the acetone.

step (c): using the tantalum layer as a working anode and a stainless steel as an auxiliary cathode, fixing both the tantalum layer and the stainless steel in an electrolysis tank and immersing both the tantalum layer and the stainless steel in a 5-10% dilute sulfuric acid solution doped with NaCl, the concentration of NaCl being 0.01%, energizing a pulsed power supply, obtaining samples of different thicknesses of tantalum oxide layers by adjusting at least one of an oxidation time, a current, a voltage, and a frequency of a power supply, taking the samples and rinsing with deionized water and then air-drying to obtain predetermined tantalum samples. During the adjustment process, it ensures that the current density on the surface of the working anode is 30-50 mA/cm$^2$, and the oxidation time is about 5-10 min. The change in surface thickness of the tantalum layer is capable of resulting in corresponding changes in the surface color and properties of the tantalum layer. Specifically, both the tantalum layer and the stainless steel may be immersed in a 6% dilute sulfuric acid solution doped with NaCl, the concentration of NaCl being 0.01%.

In some embodiments, step (a) comprises:

step (i): pre-treating the stainless steel substrate and pre-treating a tantalum rod formed by machining tantalum; and step (ii): fixing the pre-treated stainless steel substrate on a working table, connecting the pre-treated stainless steel substrate with a negative pole of a high-frequency pulsed power supply, inserting the pre-treated tantalum rod into a rotatable electrode gun, causing the pre-treated tantalum rod connecting with a positive pole of the high-frequency pulsed power supply, fixing the pre-treated tantalum rod and adjusting a rotational speed of the pre-treated tantalum rod, while turning on a protective gas to protect the pre-treated tantalum rod from oxidization and adjusting the rotational speed and parallel movement of the pre-treated tantalum rod, the pre-treated tantalum rod as a working electrode forming the tantalum layer on the surface of the stainless steel substrate.

In step (a), the tantalum to be used is processed into a round rod, the diameter of the tantalum rod is within a range of 2-6 cm, and the discharge zone of the tantalum rod head contacting the stainless steel substrate is in the conical shape, that is, the head of the tantalum rod is in the shape of a conical tip, and the cone angle of the head is within a range of 60-170°. The selected protective gas is argon, the purity of which is within a range of 98%-99.99%. The flow rate of argon is generally controlled to be within a range of 8-20 L/min during the deposition process, and the flow rate of the protective gas is optimized by observing the color of the emitted arc light. The rotational speed of the tantalum rod is controlled to be within a range of 200 r/min-500 r/min, thereby preventing strong bonding between the tantalum rod and the stainless steel substrate during the deposition process. For example, the flow rate of argon is 4 L/min, 6 L/min, 8 L/min, 10 L/min, 12 L/min, 14 L/min, 16 L/min, etc., correspondingly, the rotational speed of the tantalum rod is adjusted to 200 r/min, 250 r/min, 300 r/min, 350 r/min, 400 r/min, 450 r/min, 500 r/min, etc. When the flow rate of the protective gas is appropriate, it can effectively protect the metal in the molten pool and form good metallurgical bonding. The protective gas can not only effectively avoid the oxidation of the metal, but also produce a strengthening effect by constantly blowing into the cold gas flow, which makes the metal layer dense and even, and increases the wear resistance.

In some embodiments, in the step (i), the pre-treating the stainless steel substrate comprises: grinding the stainless steel substrate sequentially on a pre-grinder using 100# to 500# sandpapers (or referred to 100 grit to 500 grit sandpapers), and carrying out a sandblasting treatment to remove residual stresses on the surface and maintaining a certain degree of the surface roughness Ra of 3-5 μm for enhancing bonding between the tantalum layer and the stainless steel substrate, and then placing the stainless steel substrate in the acetone for ultrasonically cleaning for 5-10 min to remove impurities from the surface, and air-drying. Specifically, the surface roughness Ra may be 4 μm.

In some embodiments, in the step (i), the pre-treating the tantalum rod formed by machining tantalum comprises: processing the tantalum with a purity of 99.9% or more into a round rod with a diameter of 2-6 cm, a head of the round rod being processed into a conical shape, removing the surface oxide scale by grinding with a sandpaper, and then removing the surface stains of the tantalum rod by ultrasonically cleaning with acetone for 5-10 min. Specifically, the tantalum may be processed into the round rod with a diameter of 5 cm.

In some embodiments, when a flow rate of the protective gas is adjusted to cause that a brilliant blue-white glow is released between the tantalum rod and the stainless steel substrate, the flow rate of the protective gas is capable of ensuring that the tantalum rod does not oxidize under the protective gas.

In some embodiments, in the step (ii), during the process of forming the tantalum layer on the surface of the stainless steel substrate, a cumulative single spot deposition time does not exceed 80 s.

In some embodiments, in the step (ii), a rotational speed of the tantalum rod is within a range of 200 r/min-500 r/min; a flow rate of the protective gas is within a range of 8-20 L/min, specifically, the flow rate of the protective gas is within a range of 8-14 L/min; an output power of the power supply is within a range of 400-1000 W, specifically, the output power of the power supply is 500 W; an output voltage of the power supply is within a range of 20-50 V, specifically, the output voltage of the power supply is within a range of 30-50 V; a frequency of the power supply is within a range of 400-2000 Hz, specifically, the frequency of the power supply is 1000 Hz; a discharge pulse width is within a range of 40-90 μs, specifically, the discharge pulse width is 70 μs; and a specific deposition time is within a range of 0.4-0.9 min/cm$^2$, specifically, the specific deposition time is also 0.6 min/cm$^2$.

In some embodiments, in the step (b), a gloss Ra of the tantalum layer is within a range of 0.1-0.2 μm, specifically, Ra is 0.2 μm.

In some embodiments, in the step (c), parameters of the pulsed power supply include an output voltage of 10-20 V, a current density of 30-50 mA/cm$^2$, a single-phase pulse width of 100-200 μs, and a pulse step frequency of 50-200 Hz. Specifically, the output voltage is 15 V, the current density is 40 mA/cm$^2$, the single-phase pulse width is 200 μs.

In some embodiments, in the step (c), a working distance between the working anode and the auxiliary cathode is within a range of 4-6 cm. Specifically, the working distance between the working anode and the auxiliary cathode is 5 cm.

In the present disclosure, using the high-speed rotating tantalum electrode and the stainless steel substrate to produce an instantaneous high-energy discharge at the contact moment, a high-temperature melting pool zone is formed. Tantalum and the stainless steel substrate metal at the contact point are melted and engage in metallurgical physicochemical reaction, and the melting pool forms an alloying layer under the instantaneous high temperature and high pressure. The tantalum layers with good bonding are prepared on the surface of the stainless steel substrate by constantly moving and adjusting the electrode rotation frequency during the preparation of the tantalum layers. In some embodiments of the present disclosure, the electrode material may be freely selected to form the desired metal coating; the preparation equipment is simple, and the preparation cost is low. Generally, the tantalum layer may be prepared on geometric planes or curved surfaces. Further, the preparation of the tantalum layer is carried out in a protective gas, without the need for special protective treatment devices. Only the contact point has the high energy input, the heat-affected zone of the workpiece is small, and it is not easy to produce deformation. The formed deposited layer consists of fine crystals, nanocrystalline, and even amorphous structure, with special excellent properties. In addition, the obtained tantalum layer is oxidized in a certain electrolyte after grinding and polishing, and the oxide layer may be formed with different properties by adjusting process parameters such as the current, the voltage, the oxidation time, the solution composition, etc. The different colors of tantalum oxide layers may be obtained with the change in the thickness of the oxide layer, and the formed metal layer has excellent corrosion resistance, high hardness, and good biocompatibility. The formed tantalum layer can effectively prevent the diffusion of nickel ions from the stainless steel substrate and the erosion of corrosive media in the environment.

The technical solutions of the present disclosure will be described in further detail below in connection with specific examples. It should be understood that the following examples are only exemplary for illustrating and explaining the present disclosure and should not be construed as a limitation on the protection scope of the present disclosure. Any technology realized on the basis of the foregoing contents of this disclosure is covered by the protection scope intended by this disclosure.

EXAMPLE 1

A method for regulating surface color and properties of a tantalum layer, comprising the following steps.

Tantalum with a purity of 99.9% or more was processed into a round rod with a diameter of about 4 cm, the head of the round rod was kept in the shape of a needle point, and the surface of the tantalum rod was ground sequentially by the sandpaper to remove the surface oxide scale of the tantalum rod, and then ultrasonically cleaned with the acetone to remove the surface stains of the tantalum rod for further use. The treated stainless steel substrate was used as the cathode, and the treated tantalum rod was used as the anode.

(1) The 316L stainless steel substrate was ground sequentially on a pre-grinder using 100# to 500# sandpapers to remove the oxide film on the surface, and the sandblasting treatment was carried out to remove the residual stresses on the surface and maintain a certain degree of the surface roughness of Ra about 4 μm, and then the stainless steel substrate was placed in the acetone for ultrasonically cleaning to remove the impurities from the surface, and air-dried for further use.

(2) Tantalum with a purity of 99.9% or more was processed into the round rod with a diameter of about 4 cm, the head of the round rod was processed into the conical shape with a cone angle of about 60° (e.g., a needle tip), the surface oxide scale of the tantalum rod was removed by grinding sequentially with the 100# to 500# sandpapers, and then the surface stains of the tantalum rod were removed by ultrasonically cleaning with the acetone for further use.

(3) The 316L stainless steel substrate was connected to the positive pole of the pulsed power supply of the deposition device, the bottom end of the electrode cone was fixed to the working gun, and the working gun was connected to the negative pole of the pulsed power supply of the deposition device.

(4) The pulsed power supply was energized, the deposition process parameters were the output voltage of 50 V, a specific strengthening time of about 0.7 min/cm$^2$, the flow rate of the protective gas of 10 L/min, the frequency of 2000 Hz, and the rotational speed of the electrode rod of 300 r/min, ensuring that the electrode rod does not produce strong bonding with the stainless steel substrate. The protective gas was argon, the output power was 500 W, and the discharge pulse width was 80 μs. The test was started, the electrode was closed to the surface of the stainless steel substrate, the electrode moved continuously and regularly on the surface of the stainless steel substrate, the specific strengthening time was maintained at about 0.7 min/cm$^2$, ultimately forming a tantalum coating on the stainless steel substrate, with uniform and dense coating structure and no obvious defects. An irregular fusion line was formed between the tantalum coating and the stainless steel substrate, with a uniform and seamless joint. The tantalum coating achieved good metallurgical bonding with the stainless steel substrate. At this time, an initial thickness of the formed tantalum layer was about 65 μm.

(5) The obtained tantalum layer was ground and polished to achieve the gloss Ra of 0.2 μm, at this time, the thickness of the obtained tantalum layer was about 45 μm, and the surface of the tantalum layer was cleaned with acetone. The tantalum layer was used as the anode, and the stainless steel was used as the auxiliary cathode. The tantalum layer and the stainless steel were fixed in the electrolysis tank, with the working distance between the working electrode and the auxiliary electrode of about 5 cm, and the tantalum layer and the stainless steel were immersed in a 6% dilute sulfuric acid solution doped with NaCl, with a concentration of NaCl of 0.01%. The pulsed power supply was energized, the oxidation voltage was 12 V, the single-phase pulse width was 120 μs, and the pulse step frequency was 50 Hz, and the current density of the electrode surface was about 35 mA/cm$^2$, and the oxidation time was 8 min. After oxidation, the samples were taken and rinsed with deionized water, and air-dried to obtain the predetermined tantalum samples. At this time, the formed tantalum oxide layer exhibits golden luster and the thickness of the tantalum oxide layer is 40 μm. The XRD pattern of the tantalum layer is shown in FIG. 1.

EXAMPLE 2

A method for regulating surface color and properties of a tantalum layer, comprising the following steps.

Tantalum with a purity of 99.9% or more was processed into the round rod with a diameter of about 5 cm, the head of the round rod was processed into a needle tip shape, the surface oxide scale of the tantalum rod was removed by grinding with the sandpaper, and then the surface stains of the tantalum rod was removed by ultrasonically cleaning with the acetone. The treated stainless steel substrate was used as the cathode, and the treated tantalum rod was used as the anode.

The meth included the following steps.

(1) The 316L stainless steel substrate was ground sequentially on a pre-grinder using 100# to 500# sandpapers to remove the oxide film on the material surface, and the sandblasting treatment was carried out to remove the residual stresses on the surface and maintain a certain degree of the surface roughness of Ra about 5 μm, and then the stainless steel substrate was placed in the acetone for ultrasonically cleaning to remove the impurities from the surface, and air-dried for further use.

(2) Tantalum with a purity of 99.9% or more was processed into the round rod with a diameter of about 5 cm, the head of the round rod was processed into the conical shape with a cone angle of about 60° (e.g., a needle tip), surface oxide scale of the tantalum rod was removed by grinding with the 100# to 500# sandpapers, and then the surface stains of the tantalum rod was removed by ultrasonically cleaning with the acetone for further use.

(3) The 316L stainless steel substrate was connected to the positive pole of the pulsed power supply of the deposition device, the bottom end of the electrode cone was fixed to the working gun, and the working gun was connected to the negative pole of the pulsed power supply of the deposition device.

(4) The pulsed power supply was energized, the deposition process parameters were: the output voltage of 50 V, the specific strengthening time of about 0.8 min/cm$^2$, the flow rate of protective gas of 10 L/min, the frequency of 1500 Hz, and the rotational speed of the electrode rod 300 r/min, ensuring that the electrode rod does not produce strong bonding with the stainless steel substrate. The protective gas was argon, the output power was 500 W, and the discharge pulse width was 90 μs. The test was started, the electrode was close to the surface of the stainless steel substrate, the electrode moved continuously and regularly on the surface of the stainless steel substrate, and the specific strengthening time was maintained at about 0.8 min/cm$^2$, ultimately forming a tantalum coating on the stainless steel substrate, with uniform and dense coating structure and no obvious defects. An irregular fusion line forms between the tantalum coating and the stainless steel substrate, with a uniform and seamless joint. The tantalum coating achieved good metallurgical bonding with the stainless steel substrate. At this time, a thickness of the formed tantalum layer was about 55 μm.

(5) The obtained tantalum layer was ground and polished, to achieve the gloss Ra of 0.1 μm, at this time, the thickness of the obtained tantalum layer was about 40 μm, and the tantalum surface was cleaned with acetone. The tantalum layer was used as the anode, and the stainless steel was used as the auxiliary cathode. The tantalum layer and the stainless steel were fixed in the electrolysis tank, with the working distance between the working electrode and the auxiliary electrode of about 4 cm, and the tantalum layer and the stainless steel were immersed in a 7% dilute sulfuric acid solution doped with NaCl, with a concentration of NaCl of 0.01%. The pulsed power supply was energized, the oxidation voltage was 15 V, the single-phase pulse width was 100 μs, the pulse step frequency was 80 Hz, the current density of the electrode surface was about 40 mA/cm$^2$, and the oxidation time was 10 min. After oxidation, the samples were taken and rinsed with deionized water, and air-dried to obtain the predetermined tantalum samples. At this time, the formed tantalum oxide layer exhibits metallic silver luster, and the thickness of the tantalum oxide layer is 35 μm.

EXAMPLE 3

A method for regulating surface color and properties of a tantalum layer, comprising the following steps.

Tantalum with a purity of 99.9% or more was processed into a round rod with a diameter of about 5 cm, and the head of the round rod was kept in the shape of a needle point, and the surface of the tantalum rod was ground sequentially with the sandpapers to remove the surface oxide scale of the tantalum rod, and then ultrasonically cleaned with the acetone to remove the surface stains of the tantalum rod for further use. The treated stainless steel substrate was used as the cathode and the treated tantalum rod was used as the anode.

The method included the following steps.

(1) The 316L stainless steel substrate was ground sequentially on a pre-grinder using 100# to 500# sandpapers to remove the oxide film on the surface, the sandblasting treatment was carried out to remove the residual stresses on the surface and maintain a certain degree of the surface roughness of Ra about 4 μm, and then the stainless steel substrate was placed in the acetone for ultrasonically cleaning to remove the impurities from the surface, and air-dried for further use.

(2) Tantalum with a purity of 99.9% or more was processed into the round rod with a diameter of about 5 cm, the head of the round rod was processed into the conical shape with a cone angle of about 60° (e.g., a needle tip), the surface oxide scale of the tantalum rod was removed by grinding sequentially with the 100# to 500# sandpapers, and then the surface stains of the tantalum rod were removed by ultrasonically cleaning with the acetone for further use.

(3) The 316L stainless steel substrate was connected to the positive pole of the pulsed power supply of the deposition device, the bottom end of the electrode cone was fixed to the working gun, and the working gun was connected to the negative pole of the pulsed power supply of the deposition device.

(4) The pulsed power supply was energized, the deposition process parameters were: the output voltage of 30 V, the specific strengthening time of about 0.8 min/cm$^2$, the flow rate of the protective gas of 15 L/min, the frequency of 2000 Hz, and rotational speed of the electrode rod of 300 r/min, ensuring that the electrode rod does not produce strong bonding with the stainless steel substrate. The protective gas was argon, the output power was 400 W, and the discharge pulse width was 80 μs. The test was started, the electrode was close to the surface of the stainless steel substrate, the electrode moved continuously and regularly on the surface of the stainless steel substrate, and the specific strengthening time was maintained at about 0.8 min/cm$^2$, ultimately forming a tantalum coating on the stainless steel substrate, with uniform and dense coating structure and no obvious defects. An irregular fusion line was form between the tantalum coating and the stainless steel substrate, with a uniform and seamless joint. The tantalum coating achieved good metallurgical bonding with the stainless steel substrate. At this time, the initial thickness of the formed tantalum coating was about 55 μm.

(5) The obtained tantalum layer was und and polished to achieve the gloss Ra of 0.1 μm, at this time, the thickness of the obtained tantalum layer was about 40 μm, and the tantalum surface was cleaned with the acetone. The tantalum layer was used as the anode, and the stainless steel was used as the auxiliary cathode. The tantalum layer and the stainless steel were fixed in the electrolysis tank, with the working distance between the working electrode and the auxiliary electrode of about 4 cm, and the tantalum layer and the stainless steel were immersed in an 8% dilute sulfuric acid solution doped with NaCl, with a concentration of NaCl of 0.01%. The pulsed power supply was energized, the oxidation voltage was 15 V, and the current density of the electrode surface was about 40 mA/cm$^2$, the oxidation time was 10 min, the single-phase pulse width was 100 μs, and the pulse step frequency was 100 Hz. After oxidation, the samples were taken and rinsed with deionized water, and air-dried to obtain the predetermined tantalum samples. At this time, the formed tantalum oxide layer exhibits metallic dark blue luster, and the thickness of the tantalum oxide layer is 30 μm.

The electrochemical parameters of the potentiodynamic polarization curves of the tantalum layers obtained in the above three examples are shown in Table 1.

TABLE 1

Electrochemical parameters of the potentiodynamic polarization curves of the tantalum layers obtained in the three examples

| | Corrosion potential (V) | Corrosion current ($A \cdot cm^{-2}$) |
|---|---|---|
| Example 1 | −0.53 | $1.2 \times 10^{-4}$ |
| Example 2 | −0.48 | $1.5 \times 10^{-4}$ |
| Example 3 | −0.56 | $5.6 \times 10^{-4}$ |

The above-described specific examples provide a further detailed description of the technical problems, technical solutions, and beneficial effects solved by the present disclosure, and it should be understood that the above-described specific examples are only specific embodiments of the present disclosure, and are not intended to limit the present disclosure. Any modifications, equivalent replacements, improvements, etc. made within the spirit and principles of this disclosure shall be included in the scope of protection of this disclosure.

What is claimed is:

1. A method for regulating surface color and properties of a tantalum layer, comprising:

step (a) forming the tantalum layer with a thickness of 40-70 μm on a surface of a stainless steel substrate;

step (b) grinding the tantalum layer, followed by polishing to planarize the tantalum layer to achieve a lustrous metallic finish, and controlling the thickness of the tantalum layer within a range of 40-50 μm; and step (c) using the tantalum layer as a working anode and a stainless steel as a cathode, fixing both the tantalum layer and the stainless steel in an electrolysis tank and immersing both the tantalum layer and the stainless steel in a sulfuric acid solution doped with NaCl, energizing a pulsed power supply, and obtaining samples of different thicknesses of tantalum oxide layers by adjusting at least one of an oxidation time, a current, a voltage, and a frequency of a power supply; wherein a change in surface thickness of the tantalum layer is capable of resulting in corresponding changes in the surface color and properties of the tantalum layer.

2. The method of claim 1, wherein the step (a) comprises:

step (i) pre-treating the stainless steel substrate and pre-treating a tantalum rod formed by machining tantalum; and step (ii) connecting the pre-treated stainless steel substrate with a negative pole of a high-frequency pulsed power supply, inserting the pre-treated tantalum rod into a rotatable electrode gun, causing the pre-treated tantalum rod connecting with a positive pole of the high-frequency pulsed power supply, fixing the pre-treated tantalum rod and adjusting a rotational speed of the pre-treated tantalum rod, while turning on a protective gas to protect the pre-treated tantalum rod from oxidization and adjusting the rotational speed and parallel movement of the pre-treated tantalum rod, the pre-treated tantalum rod as a working electrode forming the tantalum layer on the surface of the stainless steel substrate.

3. The method of claim 2, wherein in the step (i), the pre-treating the stainless steel substrate comprises:

grinding the stainless steel substrate sequentially on a pre-grinder using a sandpaper, and carrying out a sandblasting treatment to remove residual stresses on the surface and maintaining a certain degree of surface roughness for enhancing bonding between the tantalum layer and the stainless steel substrate, and then placing the stainless steel substrate in acetone for ultrasonically cleaning to remove impurities from the surface, and air-drying.

4. The method of claim 2, wherein in the step (i), the pre-treating tantalum rod formed by machining tantalum comprises:

processing tantalum with a purity of 99.9% or more into a round rod, a head of the round rod being processed into a conical shape, removing surface oxide scale by grinding with a sandpaper, and then removing surface stains of the tantalum rod by ultrasonically cleaning with acetone.

5. The method of claim 2, wherein when a flow rate of the protective gas is adjusted to create a blue-white glow between the tantalum rod and the stainless steel substrate, the flow rate of the protective gas is capable of ensuring that the tantalum rod does not oxidize under the protective gas.

6. The method of claim 2, wherein in the step (ii), during a process of forming the tantalum layer on the surface of the stainless steel substrate, a cumulative single spot deposition time does not exceed 80 s.

7. The method of claim 2, wherein in the step (ii), a rotational speed of the tantalum rod is within a range of 200 r/min-500 r/min; a flow rate of the protective gas is within a range of 8-20 L/min; an output power of the power supply is within a range of 400-1000 W; an output voltage of the power supply is within a range of 20-50 V; a frequency of the power supply is within a range of 400-2000 Hz; a discharge pulse width is within a range of 40-90 μs; and a specific deposition time is within a range of 0.4-0.9 min/$cm^2$.

8. The method of claim 1, wherein in the step (b), a gloss Ra of the tantalum layer is within a range of 0.1-0.2 μm.

9. The method of claim 1, wherein in the step (c), parameters of the pulsed power supply include an output voltage of 10-20 V, a current density of 30-50 mA/$cm^2$, a single-phase pulse width of 100-200 μs, and a pulse step frequency of 50-200 Hz.

10. The method of claim 1, wherein in the step (c), a working distance between the working anode and the cathode is within a range of 4-6 cm.

* * * * *